US006817141B2

(12) United States Patent
Chen

(10) Patent No.: US 6,817,141 B2
(45) Date of Patent: Nov. 16, 2004

(54) SHUTTER ASSEMBLY FOR BEING EASILY ASSEMBLED

(76) Inventor: Chang Than Chen, 12F, No. 426, Ming Chuan 2nd Road, Chien Chen Chu, Kaohsiung (TW), 806

( * ) Notice: Subject to any disclaimer, the term of this patent is extended or adjusted under 35 U.S.C. 154(b) by 0 days.

(21) Appl. No.: 10/376,100

(22) Filed: Feb. 28, 2003

(65) Prior Publication Data

US 2004/0168368 A1 Sep. 2, 2004

(51) Int. Cl.[7] ..... E06B 7/086
(52) U.S. Cl. ..... 49/87.1
(58) Field of Search ..... 49/74.1, 87.1, 49/403, 92.1

(56) References Cited

U.S. PATENT DOCUMENTS 5,187,896 A * 2/1993 Ross ..... 49/74.1
5,303,507 A * 4/1994 Oille ..... 49/74.1
5,778,598 A * 7/1998 Ohanesian ..... 49/74.1
6,250,012 B1 * 6/2001 Ricci ..... 49/87.1
6,622,433 B2 * 9/2003 Blachley ..... 49/506

* cited by examiner

*Primary Examiner*—Jerry Redman
(74) *Attorney, Agent, or Firm*—Charles E. Baxley

(57) ABSTRACT

A shutter device includes a frame having two stiles and two beams secured together, the stiles each has a groove to receive a rail, the rails each includes a number of orifices, and a number of blades having end projections engaged into the orifices of the rails, to rotatably secure the blades between the rails and the stiles. A control device may be coupled to the blades to move or to open and close the blades relative to the frame. The orifices may be quickly and precisely formed in the rails, with such as molding or punching processes, for allowing the blades to be quickly manufactured and assembled to the stiles with the rails.

3 Claims, 4 Drawing Sheets

SHUTTER ASSEMBLY FOR BEING EASILY ASSEMBLED

BACKGROUND OF THE INVENTION

1. Field of the Invention

The present invention relates to a shutter assembly, and more particularly to a shutter assembly having an improved structure for allowing the shutter assembly to be easily and quickly manufactured and assembled.

2. Description of the Prior Art

Typical shutter assemblies comprise a number of slats or blades pivotally or rotatably attached between two posts, and rotatable between opening positions and closed positions.

For example, as shown in FIG. 1, illustrated is one of the typical shutter assemblies which comprises a frame 1 including two stiles 10 and two beams 20 to be secured together to form a rectangular frame 1, and to form or define an opening 12 within the frame 1, and one or more blades 30 received in the opening 12 of the frame 1 and to be pivotally or rotatably secured between the stiles 10.

Each of the stiles 10 includes an inner side or surface to be drilled with a number of holes 11 therein, and each of the beams 20 includes one or more pins or projections 21 extended laterally and outwardly from each of their ends, to engage into the holes 11 of the stiles 10, and to secure the beams 20 between the stiles 10. The blades 30 each includes a pin or projection 31 extended laterally and outwardly from each of their ends, to engage into the holes 11 of the stiles 10, and to pivotally or rotatably secure the blades 30 between the stiles 10.

However, normally, the stiles 10 are required to be manually drilled or machined to form the holes 11 therein by workers, and the holes 11 normally may not be precisely formed in the required positions. In addition, it takes time to drill or to form the holes 11 in the stiles 10.

A further rod or a bar is required to be secured to the blades with such as fasteners or hooks, for allowing the blades to be rotated or controlled by the rod or bar. However, it also takes time to couple or to secure the rod or the bar to the blades.

The present invention has arisen to mitigate and/or obviate the afore-described disadvantages of the conventional shutter assemblies.

SUMMARY OF THE INVENTION

The primary objective of the present invention is to provide a shutter assembly including an improved structure for allowing the shutter assembly to be easily and quickly manufactured and assembled.

In accordance with one aspect of the invention, there is provided a shutter assembly comprising a frame including two stiles and two beams secured together to form a rectangular structure, and to define an opening within the frame, the stiles each including a groove formed therein, two rails received in the grooves of the stiles respectively and each including a plurality of orifices formed therein, and a plurality of blades each including two ends each having a projection extended therefrom and engaged into the orifices of the rails, to rotatably secure the blades between the rails and the stiles respectively. A control device may further be provided and coupled to the blades for moving the blades relative to the stiles, to open and close the blades relative to the frame. The orifices may be quickly formed in the rails with such as molding processes or punching processes, or the like, for allowing the blades to be quickly manufactured and assembled to the stiles with the rails.

The rails each may include a space formed therein and communicating with the orifices thereof.

The control device includes a bar having a plurality of hooks provided thereon to hook to the blades respectively. The blades each may include a coupler attached thereto to couple to the hooks of the bar respectively. The hooks of the bar each may include a slit formed therein to engage the couplers of the blades into the hooks respectively.

A rod may further be provided and includes a slot formed therein to receive the bar. The rod includes an enlarged aperture formed therein and communicating with the slot thereof, the bar includes an enlarged rim formed thereon and received in the aperture of the rod, to stably retain the bar in the rod.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
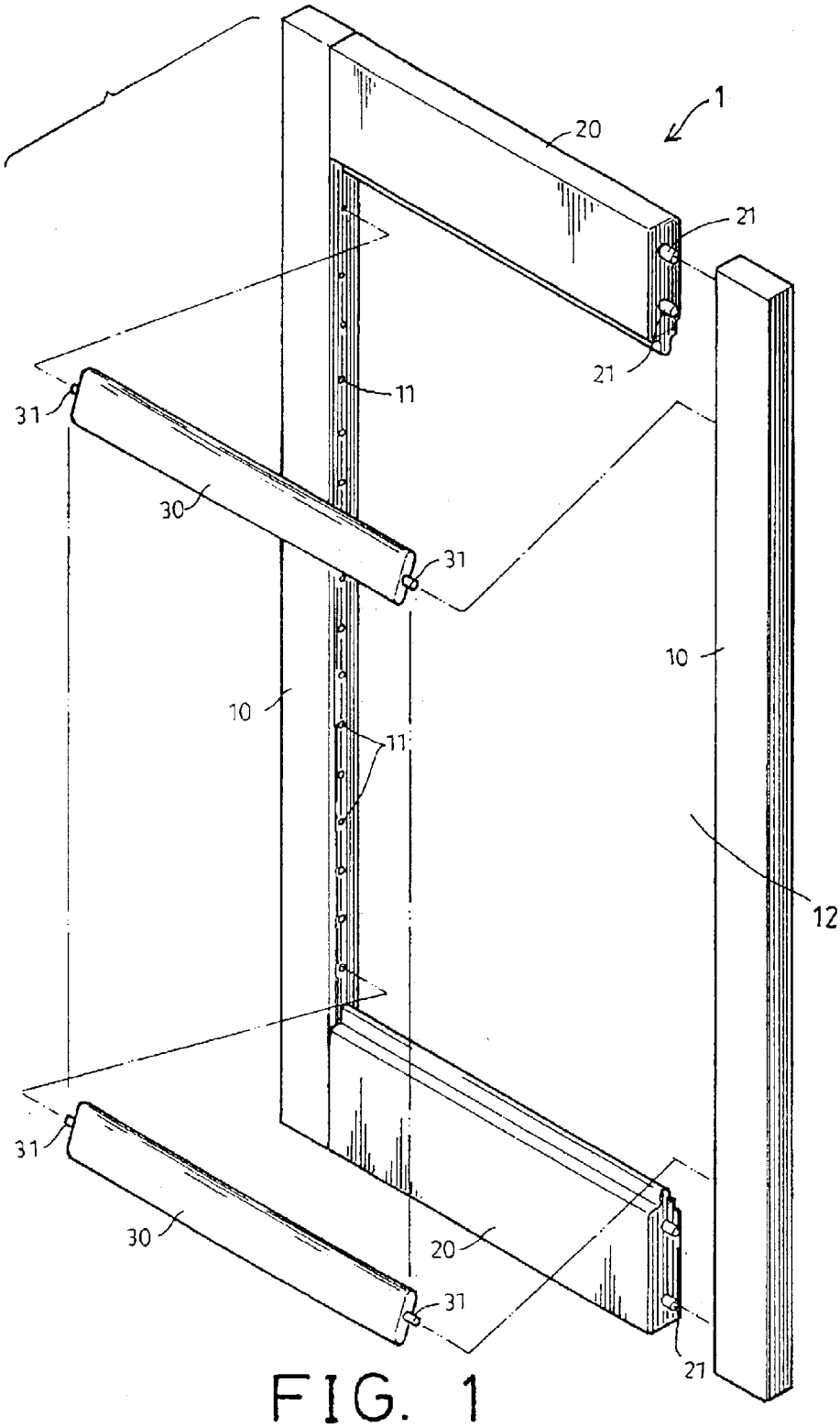
FIG. 1 PRIOR ART
FIG. 1 is a partial exploded view illustrating one of the typical shutter assemblies.
Figure 2:
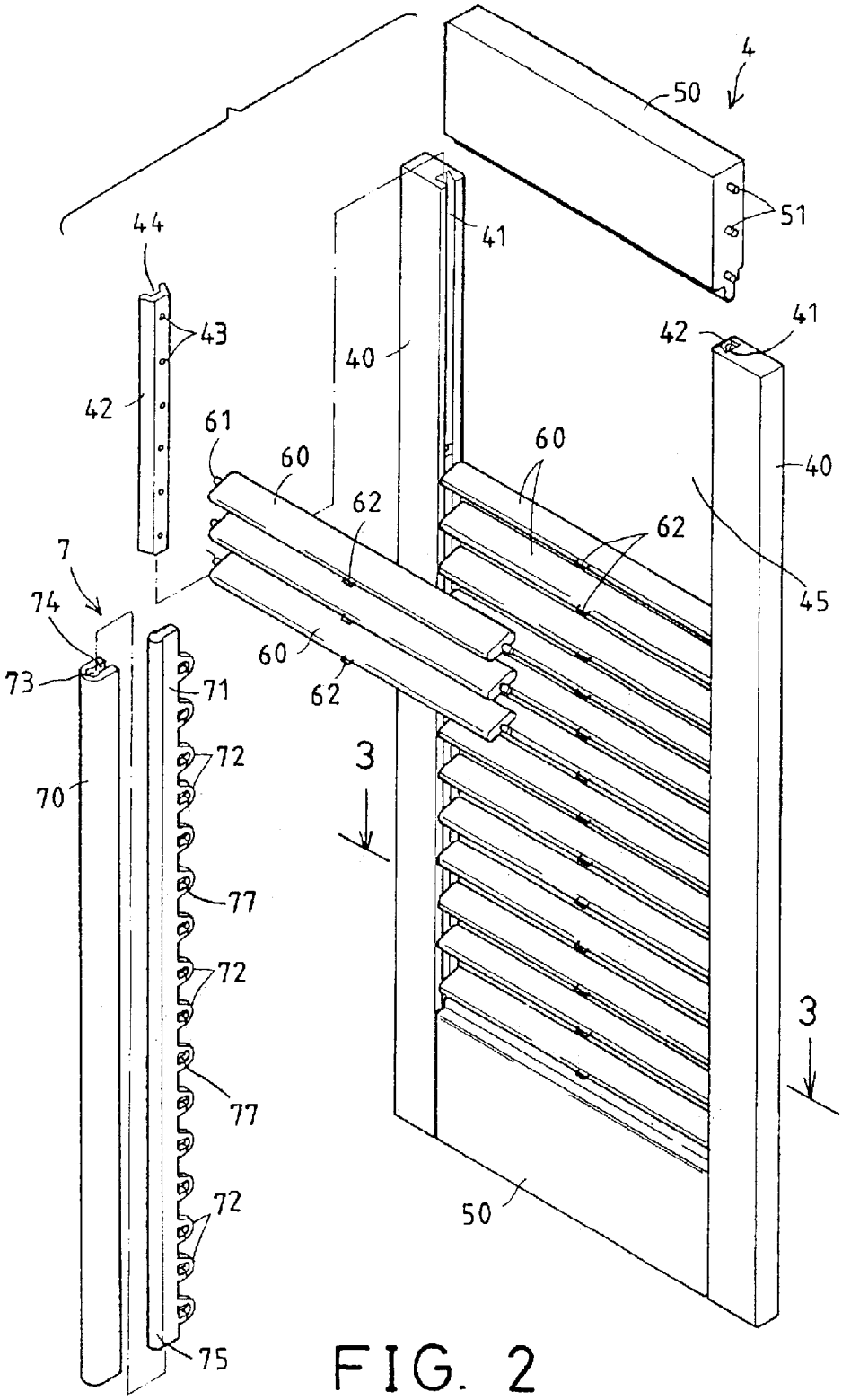
FIG. 2 is a partial exploded view of a shutter assembly in accordance with the present invention.
Figure 3:
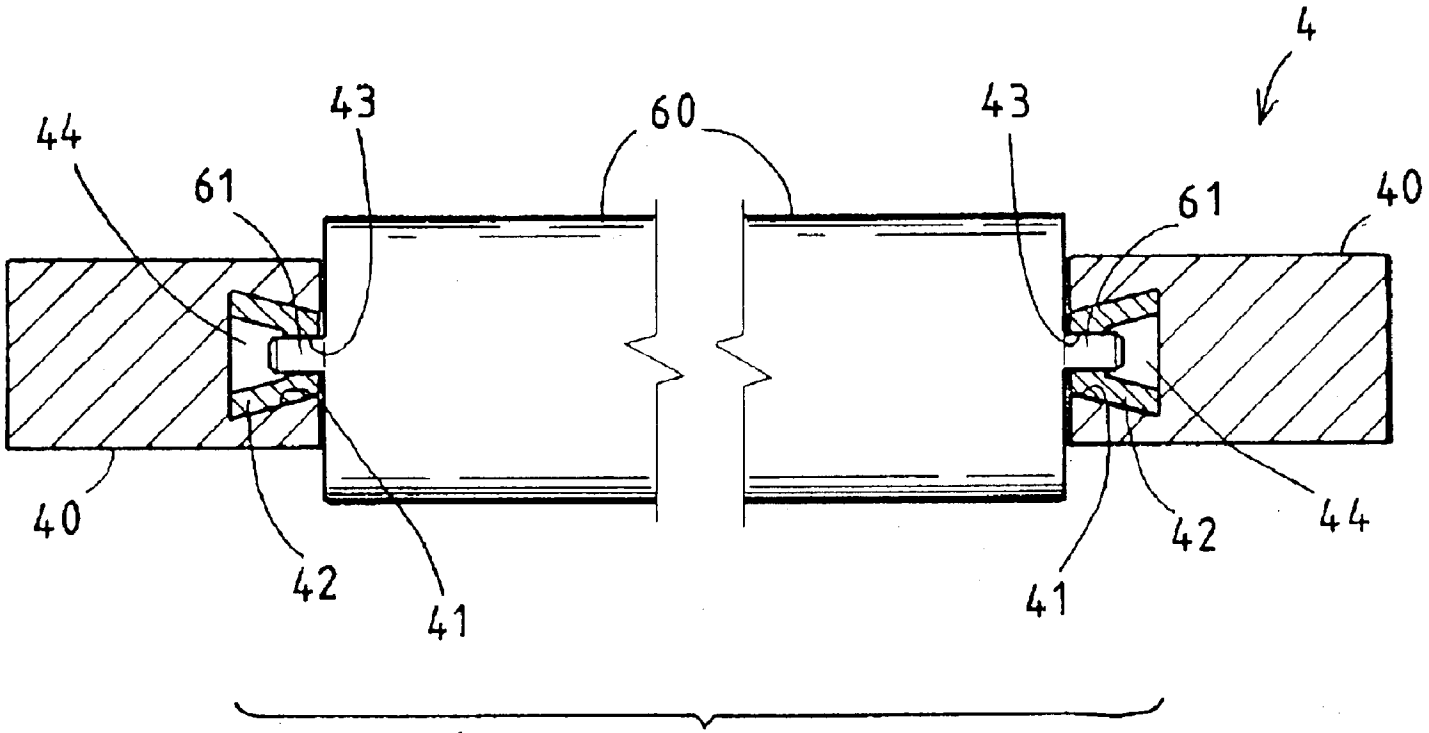
FIG. 3 is a partial cross sectional view taken along lines 3—3 of FIG. 2.
Figure 5:
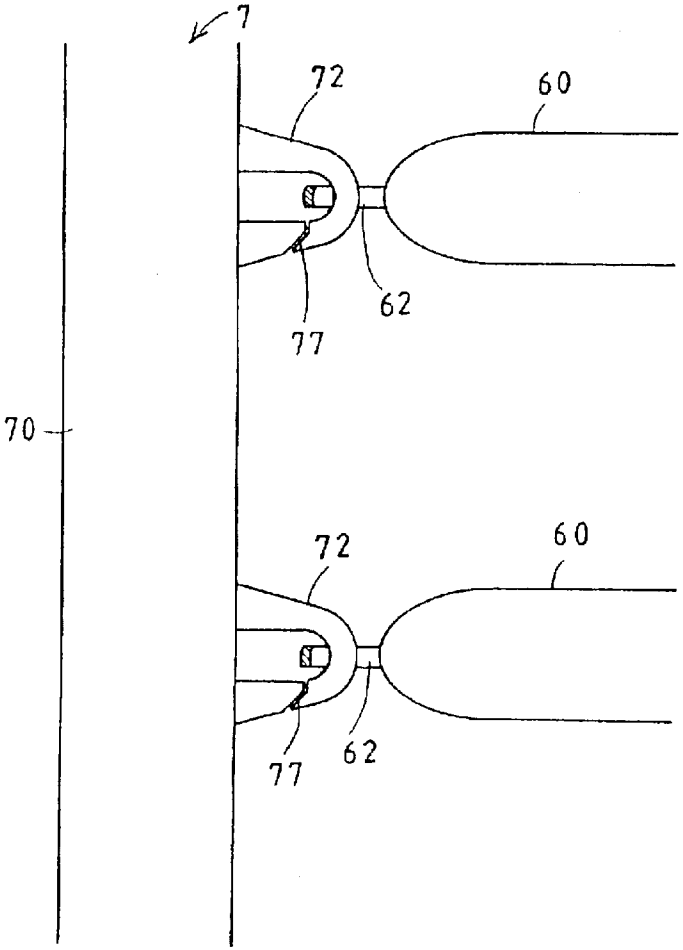
FIG. 5 is a partial side view of the shutter assembly, illustrating the attachment or the coupling of a control device to the blades of the shutter assembly.
Figure 4:
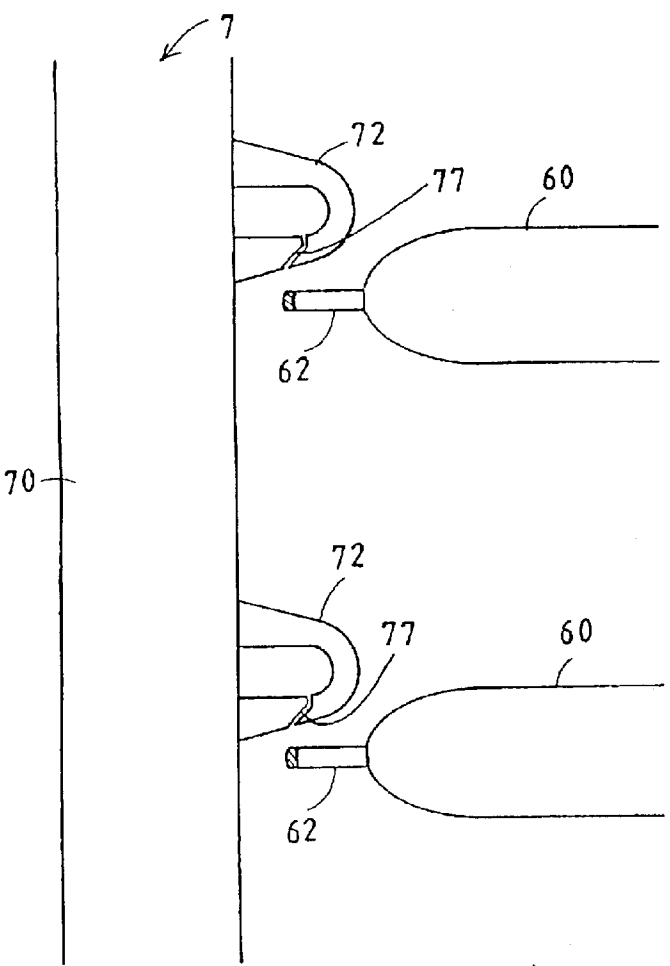
FIG. 4 is a partial side and exploded view of the shutter assembly.

Referring to the drawings, and initially to FIGS. 2–4, a shutter assembly in accordance with the present invention comprises a frame 4 including two stiles 40 and two beams 50 to be secured together to form a rectangular frame 4, and to form or define an opening 45 within the frame 4, and one or more blades 60 to be received in the opening 45 of the frame 4 and to be pivotally or rotatably secured between the stiles 40.

Each of the stiles 40 includes an inner side or surface having a channel or groove 41, such as a dovetail groove 41 formed therein, and a rail 42 to be received or secured in the groove 41 thereof. Each of the rails 42 includes a dovetail cross section corresponding to that of the dovetail groove 41 of the stile 40, for allowing the rails 42 to be snugly received or retained in the respective dovetail groove 41 of the stile 40.

The rails 42 may be secured in the stiles 40 with such as force-fitted engagements, adhesive materials, fasteners, latches, or the like, and each includes a C or U-shaped structure having a longitudinal space 44 formed therein, and each includes a number of orifices 43 formed therein, such as formed along the length thereof and spaced away from each other, and communicating with the longitudinal space 44 thereof.

Each of the beams 50 includes one or more pins or projections 51 extended laterally and outwardly from each of their ends, to engage into the orifices 43 of the stiles 40, and to secure the beams 50 between the stiles 40 with such as force-fitted engagements, adhesive materials, fasteners, latches, or the like, and in order to form the rectangular frame 4 that includes the opening 45 formed or defined therein.

The blades 60 each includes a pin or projection 61 extended laterally and outwardly from each of their ends, to engage into the orifices 43 of the rails 42 of the stiles 40 respectively, and to pivotally or rotatably secure the blades 60 between the stiles 40 or between the rails 42 of the stiles 40, for allowing the blades 60 to be rotated relative to the stiles 40 and the rails 42. Each of the blades 60 includes a nail or hook or U-shaped coupler 62 secured thereto.

It is to be noted that the dovetail groove 41 may be easily and quickly formed in the stiles 40, and the orifices 43 and/or the spaces 44 may also be easily and quickly formed in the rails 42 respectively by such as molding processes, punching processes or the like, for allowing the frame 4 to be quickly formed or manufactured. The beams 50 and the blades 60 may also be easily and quickly assembled or secured between the stiles 40.

A control member or device 7 is further provided to control or to open or to close or to move the blades 60 relative to the frame 4, and includes a rod 70 and a bar 71 to be attached to the rod 70. For example, the rod 70 includes a slot 74 formed therein to receive and retain the bar 71 therein, and an aperture 73 formed therein and having a diameter or width greater than the width of the slot 74 of the rod 70.

The bar 71 includes an enlarged head or bead or rim 75 formed on one end thereof and having a diameter or width greater than the width of the slot 74 of the rod 70, but equals to or slightly smaller than that of the aperture 73 of the rod 70, for allowing the rim 75 to be snugly received and retained within the aperture 73 of the rod 70, and thus for preventing the bar 71 from being disengaged from the rod 70. The bar 71 may further be secured to the rod 70 with fasteners, catches, hooks, adhesive materials, or by welding processes, etc.

The bar 71 includes a number of catches or hooks 72 formed or extended on the other end thereof, for hooking or engaging with the couplers 62 of the blades 60 respectively, in order to control or to move or to open or to close the blades 60 relative to the frame 4. Each of the hooks 72 of the bar 71 includes a slit 77 formed therein, such as an inclined slit 77 formed in the lower portion thereof, for receiving the couplers 62 therein respectively.

The hooks 72 may be formed on the bar 71 by such as molding processes, punching processes or the like, for allowing the hooks 72 to be quickly and precisely formed on the bar 71, and thus for allowing the hooks 72 to be quickly and precisely hooked or coupled to the couplers 62 of the blades 60 respectively. The bar 71 and the hooks 72 may be may be made of resilient materials, such as aluminum, plastic, rubber, or the other synthetic materials, for allowing the bar 71 and the hooks 72 to be quickly manufactured.

The stiles 40 and/or the beams 50 and/or the rails 42 and/or the rod 70 and/or the bar 71 may also be made of resilient materials, such as aluminum, foamable, rubber, plastic, or other synthetic materials. However, it is preferable that the bar 71 and the rails 42 are made of stronger materials, such as aluminum, synthetic, metal material or the like, for increasing the coupling between the blades 60 and the rails 42, or between the blades 60 and the bar 71 of the control device 7.

Accordingly, the shutter assembly in accordance with the present invention includes the rails, the stiles, the blades and the control device 7 to be easily and quickly manufactured and assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shutter assembly comprising:

a frame including two stiles and two beams secured together to form a rectangular structure, and to define an opening within said frame, said stiles each including a groove formed therein, two rails received in said grooves of said stiles respectively, and each including a plurality of orifices formed therein, a plurality of blades each including two ends each having a projection extended therefrom and engaged into said orifices of said rails, to rotatably secure said blades between said rails and said stiles respectively, means for moving said blades relative to said stiles, to open and close said blades relative to said frame, said moving means including a bar having a plurality of hooks provided thereon to hook to said blades respectively, a rod including a slot formed therein to receive said bar, and wherein each of said blades includes a coupler extending from said blades and attached thereto to couple to said hooks of said bar respectively.

2. The shutter assembly as claimed in claim 1, wherein each of said hooks of said bar includes a slit formed therein to engage said couplers of said blades into said hooks respectively.

3. The shutter assembly as claimed in claim 1, wherein said rod includes an enlarged aperture formed therein and communicating with said slot thereof, said bar includes an enlarged rim formed thereon and received in said aperture of said rod, to retain said bar in said rod.

* * * * *